US009848660B1

(12) United States Patent
Castro

(10) Patent No.: US 9,848,660 B1
(45) Date of Patent: Dec. 26, 2017

(54) GARMENT WITH TWO WAISTBANDS

(71) Applicant: Dwayne Castro, Brooklyn, NY (US)

(72) Inventor: Dwayne Castro, Brooklyn, NY (US)

( * ) Notice: Subject to any disclaimer, the term of this patent is extended or adjusted under 35 U.S.C. 154(b) by 3 days.

(21) Appl. No.: 15/164,949

(22) Filed: May 26, 2016

(51) Int. Cl.

| | |
|---|---|
| ***A41F 9/00*** | (2006.01) |
| ***A41D 1/14*** | (2006.01) |
| ***A41D 1/06*** | (2006.01) |
| ***A41D 27/08*** | (2006.01) |
| ***A41D 27/20*** | (2006.01) |

(52) U.S. Cl.
CPC ..... *A41F 9/00* (2013.01); *A41D 1/06* (2013.01); *A41D 1/14* (2013.01); *A41D 27/08* (2013.01); *A41D 27/20* (2013.01)

(58) Field of Classification Search
CPC .... A41F 9/00; A41D 1/06; A41D 1/14; A41D 27/08; A41D 27/20
See application file for complete search history.

(56) References Cited

U.S. PATENT DOCUMENTS

| | | | | | |
|---|---|---|---|---|---|
| 4,188,672 | A * | 2/1980 | Kalso | A41F 9/025 | 128/96.1 |
| D262,325 | S * | 12/1981 | Miller | D2/742 | |
| 5,050,244 | A * | 9/1991 | Kleinman | A41D 1/067 | 2/227 |
| 5,153,944 | A | 10/1992 | Teel | | |
| 5,689,832 | A * | 11/1997 | Head | A41D 1/062 | 2/227 |
| 6,202,220 | B1 * | 3/2001 | Rhoden | A41D 1/062 | 2/220 |
| 6,260,209 | B1 | 7/2001 | St. Ange | | |
| 6,317,894 | B1 | 11/2001 | Blechman | | |
| 6,698,029 | B2 | 3/2004 | Tadros | | |
| 6,789,270 | B1 * | 9/2004 | Pedrick | A41D 7/005 | 2/228 |
| D552,328 | S * | 10/2007 | Smith | D2/742 | |
| 7,574,752 | B1 * | 8/2009 | Walters | A41D 1/062 | 2/227 |
| 7,596,816 | B1 * | 10/2009 | Henry | A41D 1/062 | 2/227 |
| 7,814,575 | B2 * | 10/2010 | Hendrickson | A41D 1/20 | 2/227 |
| 8,813,266 | B1 * | 8/2014 | Green | A41F 7/00 | 2/229 |
| 8,832,867 | B2 | 9/2014 | Boyle | | |
| 9,044,051 | B1 * | 6/2015 | Rydman | A41D 1/06 | |
| 9,119,426 | B1 * | 9/2015 | Skanron | A41D 1/20 | |
| 9,205,965 | B2 * | 12/2015 | Vanlandingham | B65D 75/008 | |
| 9,254,010 | B2 * | 2/2016 | Hedrick | A41D 1/22 | |
| 9,277,774 | B2 * | 3/2016 | Gosse | A41D 1/082 | |
| 2005/0246818 | A1 | 11/2005 | Kim | | |
| 2005/0246820 | A1 * | 11/2005 | Davenport | A41B 9/001 | 2/227 |

(Continued)

*Primary Examiner* — Clinton T Ostrup
*Assistant Examiner* — Andrew W Sutton
(74) *Attorney, Agent, or Firm* — Michael J. Feigin, Esq.; Feigin & Fridman

(57) ABSTRACT

A garment having an outer waistband and an inner waistband, the outer waistband and the inner waistband connected by a fabric portion, wherein in a first operative mode the outer waistband is disposed adjacent the inner waistband and the fabric portion is hidden, and in a second operative mode the outer waistband droops beneath the inner waistband, and the fabric portion is visible and extends the length of the garment.

10 Claims, 7 Drawing Sheets

(56) References Cited

U.S. PATENT DOCUMENTS

| | | | | |
|---|---|---|---|---|
| 2006/0010571 | A1* | 1/2006 | Oakley | A41D 1/062<br>2/227 |
| 2013/0212779 | A1* | 8/2013 | Dowling | A41F 9/02<br>2/243.1 |

* cited by examiner

GARMENT WITH TWO WAISTBANDS

FIELD OF THE DISCLOSED TECHNOLOGY

The disclosed technology relates generally to clothing and fashion, more specifically, to garments having two waistbands which could be positioned directly over one another for a classic appearance, or one beneath the other for a fashionable drooped appearance, without exposing undergarments.

BACKGROUND OF THE DISCLOSED TECHNOLOGY

One of the modern fashions is that of wearing pants having a waistband worn relatively low or on the hips, exposing the waistband of the underpants. While this look is considered to be trendy, it is unsuitable for certain situations or under certain dress codes, such as in offices, schools, and places of prayer. Additionally, many people would like to dress in accordance with such fashion, without exposing their undergarments.

The prior art describes various types of pants having adjustable or changeable appearances.

US Patent Application Publication No. 2005/0246818 to Kim discloses pants having adjustable length by using a zipper to connect or disconnect parts of the pants from each other, such that when disconnected, respective parts of the pants are spaced apart vertically, but when zipped together the area between the respective parts is folded over such that the pants are shorter and attached. However, this reference does not relate to two waistbands which can hang one beneath the other.

U.S. Pat. No. 8,832,867 to Boyle discloses a garment with a concealed zipper system. The zipper system allows one to remove a mid-section of the legs of the pants and attach a lower portion of the leg to an upper portion, or one can attach the mid-section, by zipper, between the upper and lower parts. Thus, Boyle teaches extending or retracting the length of the pants, but does not relate to multiple waistbands, or to the fabric remaining attached to the garment also in the retracted arrangement.

U.S. Pat. No. 6,260,209 to St. Ange discloses pants which are and which include an entirely detachable inner seam which allows one to use a toilet without removing the pants. However, also this reference does not relate to the waistband of pants.

Therefore, there exists a need in the art for a garment which complies with the fashion of a drooped waistband exposing an upper waistband without exposing the wearer's undergarments, and which could be worn in the classic or standard manner when required to maintain decorum.

SUMMARY OF THE DISCLOSED TECHNOLOGY

The disclosed technology relates generally to clothing and fashion, more specifically, to garments having two waistbands which could be positioned directly over one another for a classic appearance, or one beneath the other for a fashionable drooped appearance, without exposing undergarments.

There is thus provided in accordance with an embodiment of the disclosed technology a garment including an outer waistband, an inner waistband, and a fabric portion connecting the outer waistband and the inner waistband, wherein in a first operative mode, the outer waistband is positioned adjacent the inner waistband, and the fabric portion is hidden, and in a second operative mode the outer waistband hangs below the inner waistband, and the fabric portion is visible.

In some embodiments, the garment further includes outer fasteners associated with the outer waistband and corresponding inner fasteners associated with the inner waistband, such that, when the outer fasteners and the inner fasteners are connected, the outer waistband is held in the first operative mode.

In some embodiments, the garment further includes a main body portion extending from a bottom edge of the outer waistband.

In some embodiments, decorative elements are provided only on the main body portion. In other embodiments, decorative elements are provided on the main body portion and on the fabric portion.

In some embodiments, the fabric portion and the main body portion are made of different fabrics. In some such embodiments, a fabric forming the fabric portion is thinner than a fabric forming the main body portion.

In some embodiments, the main body portion includes a main opening, and the fabric portion includes a secondary opening, and wherein in the first operative mode, the main opening and the secondary opening are aligned. In some such embodiments, in the second operative mode, only the second opening need be opened for wearing and removal of the garment.

In some embodiments, the garment comprises pants. In some embodiments, the garment comprises a skirt. In some embodiments, the garment comprises a skort.

In some embodiments, in the first operative mode the garment is shorter than in the second operative mode. In some such embodiments, a length of the garment in the second operative mode is greater than a length of the garment in the first operative mode by an amount equal to a length of the fabric portion.

Any device or step to a method described in this disclosure can comprise or consist of that which it is a part of, or the parts which make up the device or step. The term "and/or" is inclusive of the items which it joins linguistically and each item by itself.

DETAILED DESCRIPTION OF EMBODIMENTS OF THE DISCLOSED TECHNOLOGY

In an embodiment of the disclosed technology, a garment includes an outer waistband, an inner waistband, and a fabric portion connecting the outer waistband and the inner waistband, wherein in a first operative mode, the outer waistband is positioned adjacent the inner waistband, and the fabric portion is hidden, and in a second operative mode the outer waistband hangs below the inner waistband, and the fabric portion is visible.

Embodiments of the disclosed technology will become clearer in view of the following description of the drawings.

Figure 1:
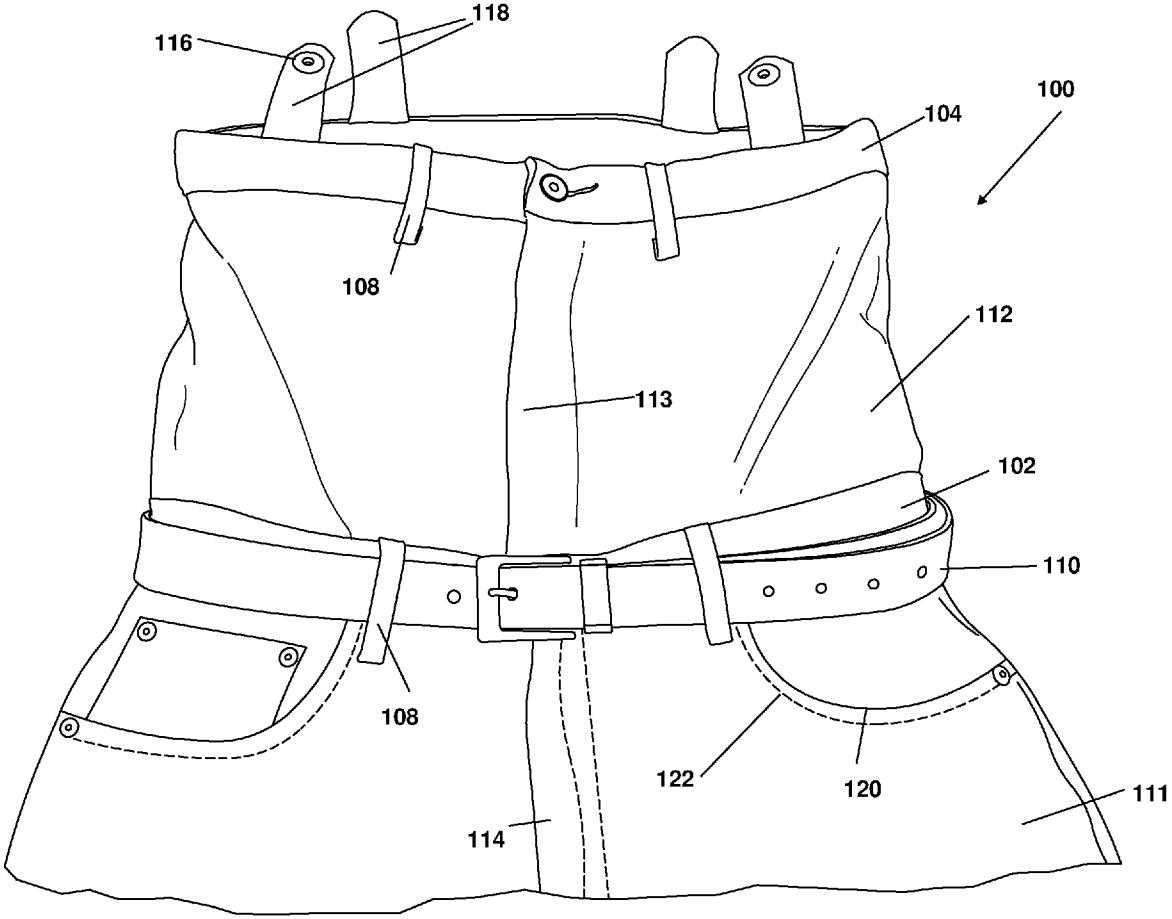
FIG. 1 shows a front view of a garment according to an embodiment of the disclosed technology, where the outer waistband droops beneath the inner waistband.

Reference is now made to FIG. 1, which shows a front view of a garment 100 including an outer waistband 102 and an inner waistband 104, the outer waistband drooping beneath the inner waistband. Outer waistband 102 and inner waistband 104 may both be standard waistbands, including a fastener 116, such as a button or hook-and-eye arrangement for opening and closing the waistband and belt loops 108 for threading a belt there through. In the illustrated embodiment, a belt 110 is threaded through the belt loops 108 of the outer waistband 102.

The outer waistband 102 extends from a main body portion 111 of the garment. Additionally, the outer waistband 102 and the inner waistband 104 are connected to one another by a fabric portion 112 extending from the bottom edge of the inner waistband 104 to the inner surface or to a top edge of the outer waistband 102.

In some embodiments, the main body portion 111 includes a fly or zipper 113 and the fabric portion 112 includes a slit, opening, or fly 114. In some embodiments, inner waistband 104 includes one or more fasteners 116, which may be mounted onto tabs 118, for securing the inner waistband 104 to the outer waistband 102 as explained in further detail hereinbelow.

In some embodiments, decorative features such as pockets 120, embroidery, stitching 122 and the like, may be provided only on the main body portion 111, as shown in FIG. 1. However, it will be appreciated that such decorative features may also be provided on fabric portion 112, for example adjacent inner waistband 104.

Figure 2:
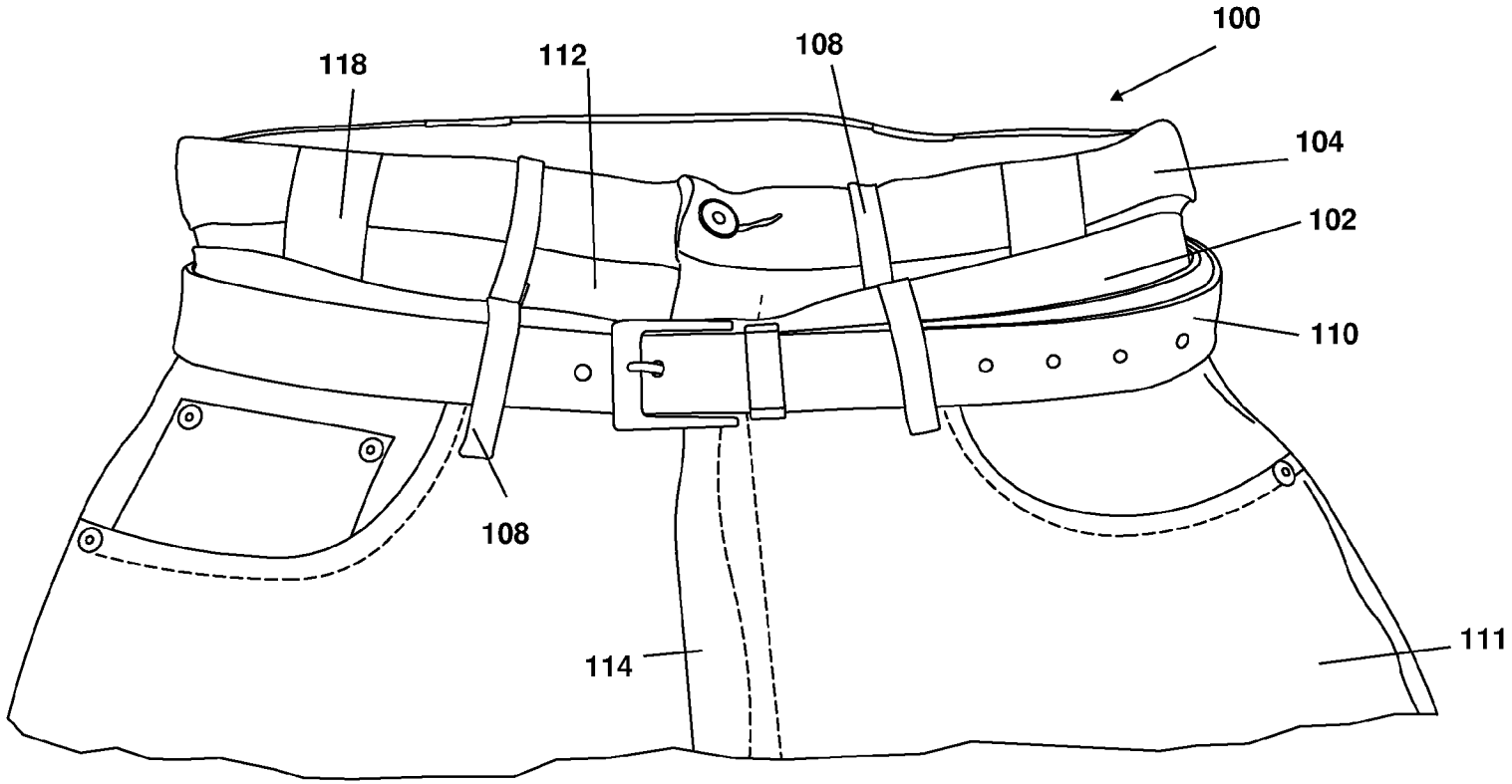
FIG. 2 shows a front view of a garment according to an embodiment of the disclosed technology, where the outer waistband is disposed adjacent the inner waistband.

FIG. 2 shows a front view of garment 100 of FIG. 1, where the outer waistband 102 is disposed adjacent the inner waistband 104. As seen, the belt 110 is still threaded through the loops 108 of the outer waistband, and fabric portion 112 is invisible, and is folded behind a top section of main body portion 111. It is a particular feature of the disclosed technology that fabric portion 112 remains connected to main body portion 111 in the orientation shown in FIG. 2.

It is appreciated that in the orientation of FIG. 2, when fabric portion 112 is folded into the garment 100, the length of garment 100 from the inner waistband to the bottom end thereof is shorter than in the orientation of FIG. 1, in which the fabric portion 112 contributes to the length of the garment 100. In some embodiments, the length of the garment in the orientation of FIG. 1 is greater than the length of the garment in the orientation of FIG. 2 by an amount equal to the length of fabric portion 112.

It is further appreciated that the fabric portion 112 may be of the same type of fabric as the main body portion 111, or may be of a different material. For example, if the main body portion 111 is made of denim or another thick or rigid fabric, the fabric portion 112 may be a cotton fabric or other thin flexible fabric, so as to reduce bulk at the top of the garment when the fabric portion 112 is folded behind the main body portion 111. Additionally, the fabrics of main body portion 111 and of fabric portion 112 may have different patterns, colors, or appearances.

Figure 3:
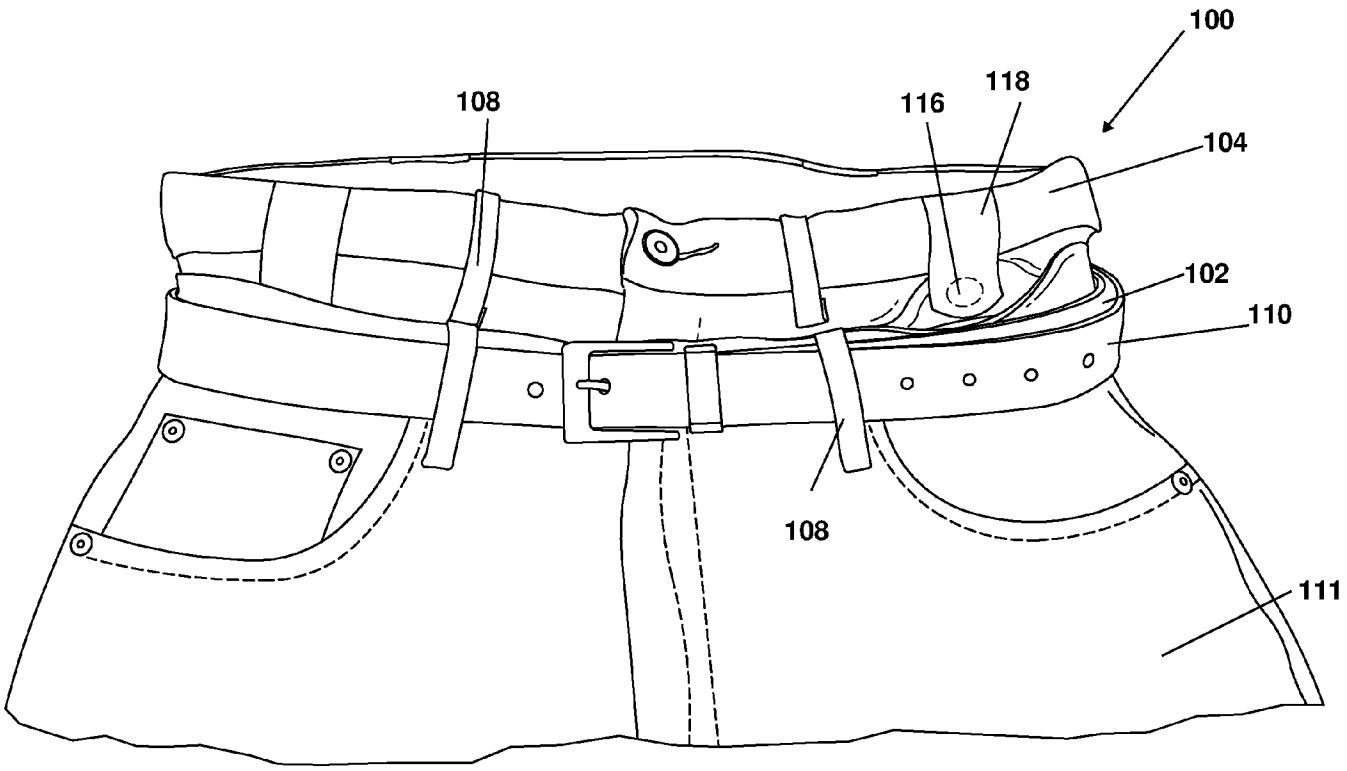
FIG. 3 shows the garment of FIG. 2, where the inner waistband is fastened to the outer waistband by fasteners.

FIG. 3 shows the garment 100 of FIG. 2, where the inner waistband 104 is fastened to the outer waistband 102. Specifically, as mentioned above with reference to FIG. 1, extending from inner waistband 104 are tabs 118 having fasteners 116 thereon. Corresponding fasteners 124 are attached to an inner surface of outer waistband 102 or to main body portion 111. Connection of fasteners 116 to fasteners 124, as illustrated in FIG. 3, ensures that the outer waistband 102 will remain in position relative to inner waistband 104, and will not droop below the inner waistband, even if the position of garment 100 is shifted or if the wearer opens the garment or removes it.

Figure 4:
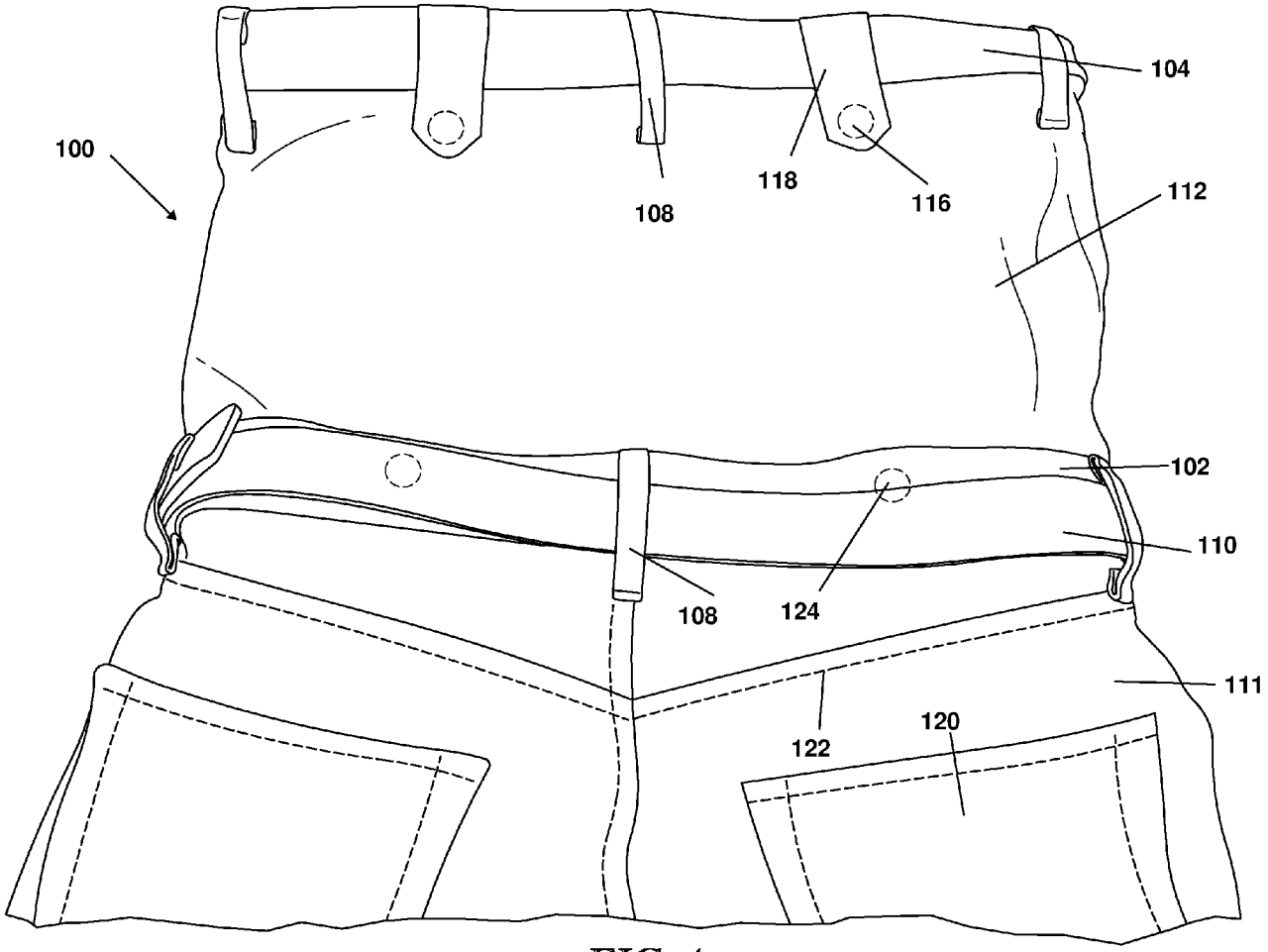
FIG. 4 shows a rear view of a garment according to an embodiment of the disclosed technology, where the outer waistband droops beneath the inner waistband.

FIG. 4 shows a rear view of the garment 100 when the outer waistband 102 droops beneath the inner waistband 104. As seen in FIG. 4, fasteners 116 on tabs 118 are attached to the inner waistband 104, and corresponding fasteners 124 are attached to the inner waistband 102 also on a rear side of the garment 100. Similarly, it is seen that decorative elements, such as pockets 120 and stitching 122 are not provided on fabric portion 112 also on a rear side thereof. However, it will be appreciated that in some embodiments, such decorative features may be provided on the rear side of fabric portion 112.

Figure 5:
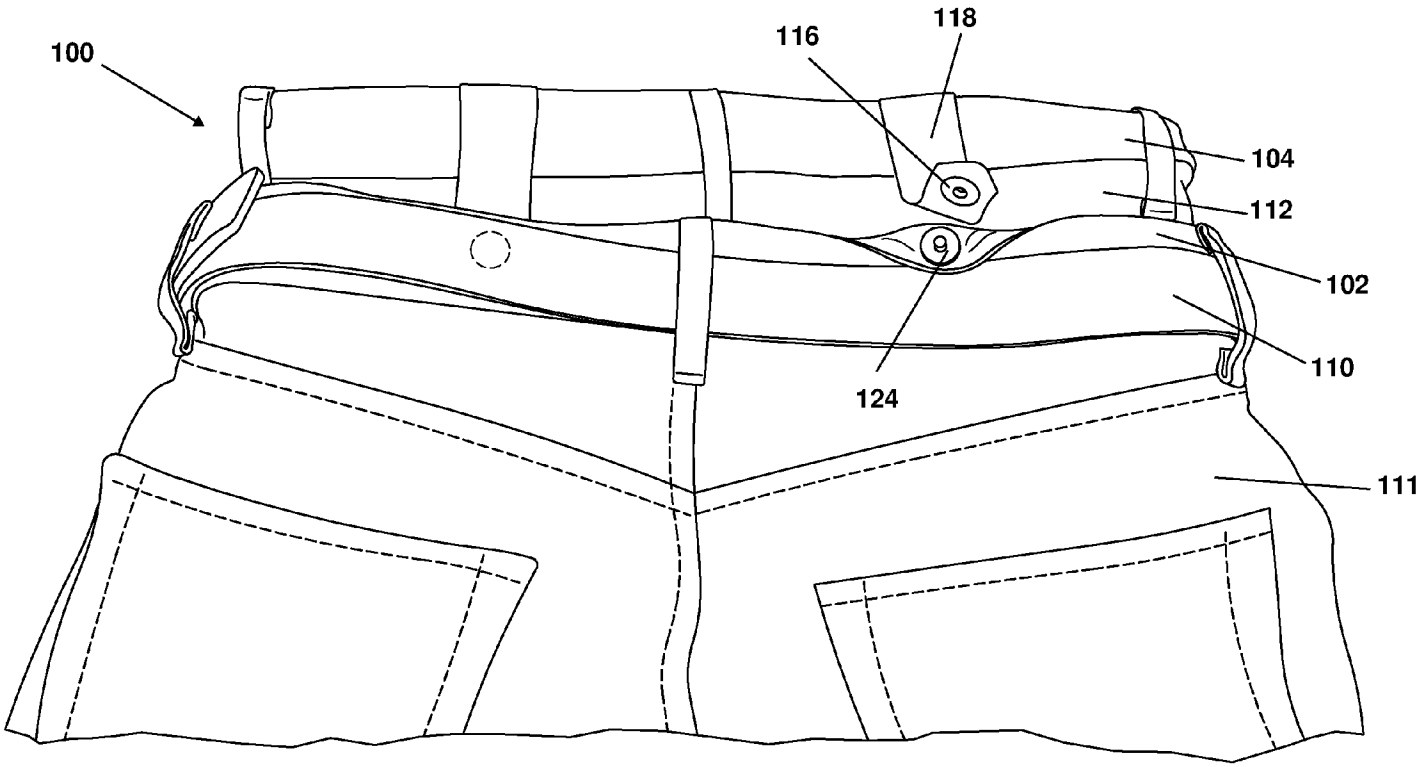
FIG. 5 shows a rear view of a garment according to an embodiment of the disclosed technology, where the outer waistband is disposed adjacent the inner waistband, and the inner waistband is fastened to the outer waistband by fasteners.

FIG. 5 shows the garment 100 of FIG. 4, where the outer waistband 102 is disposed adjacent inner waistband 104 and is fastened thereto via fastening of fasteners 116 on tabs 118 with corresponding fasteners 124.

Figure 6:
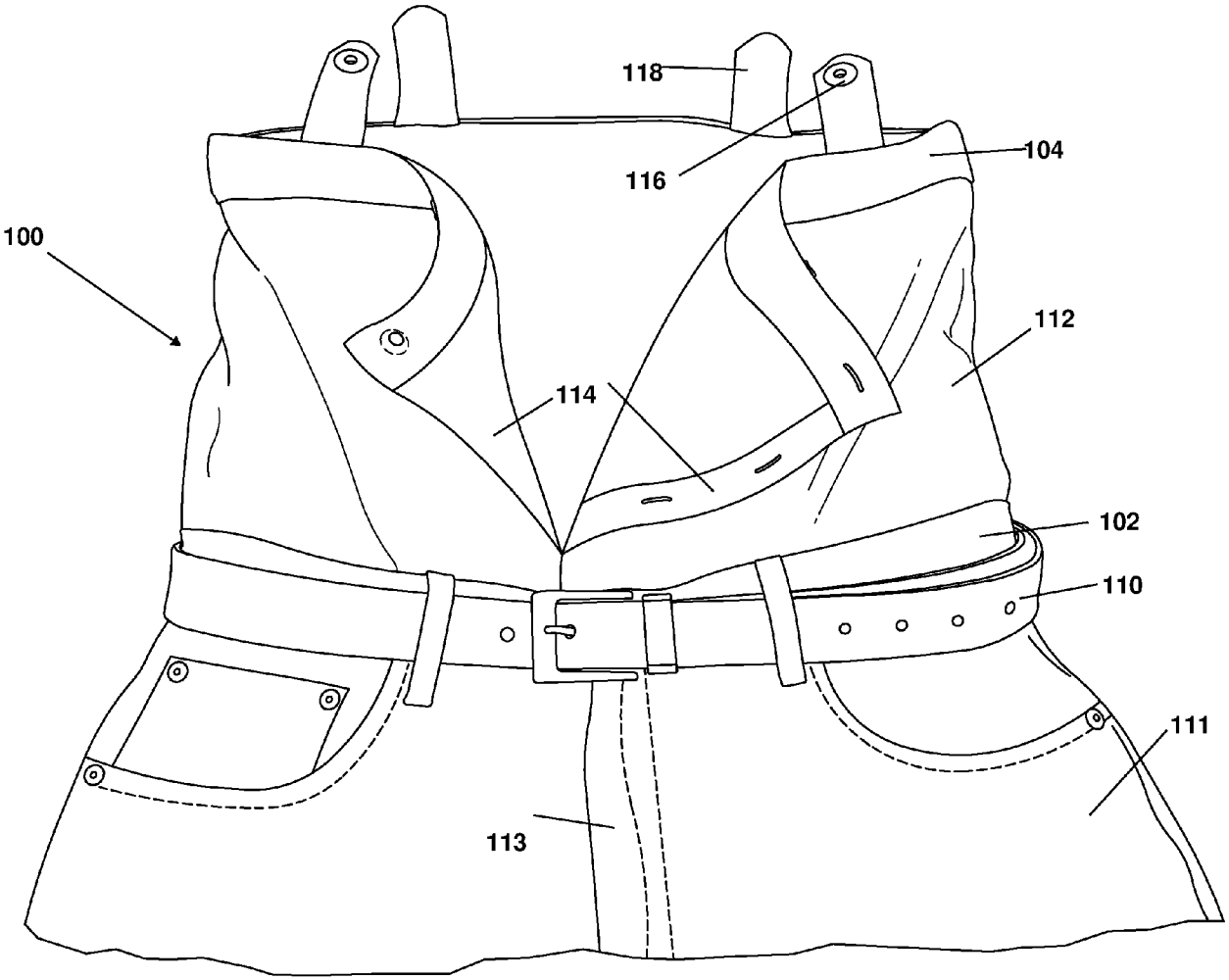
FIG. 6 shows a front view of a garment according to an embodiment of the disclosed technology, where the outer waistband droops beneath the inner waistband and a slit connected to the inner waistband is used to open the garment.

FIG. 6 shows a front view of garment 100 when the outer waistband 102 droops beneath the inner waistband 104, as shown in FIGS. 1 and 4. In the arrangement of FIG. 6, the fly 113 of the main body portion 111 may remain closed, and in some cases buckled behind belt 110, and the slit 114 in fabric portion 112 may be used to enable the user to put on and remove the garment.

Figure 7:
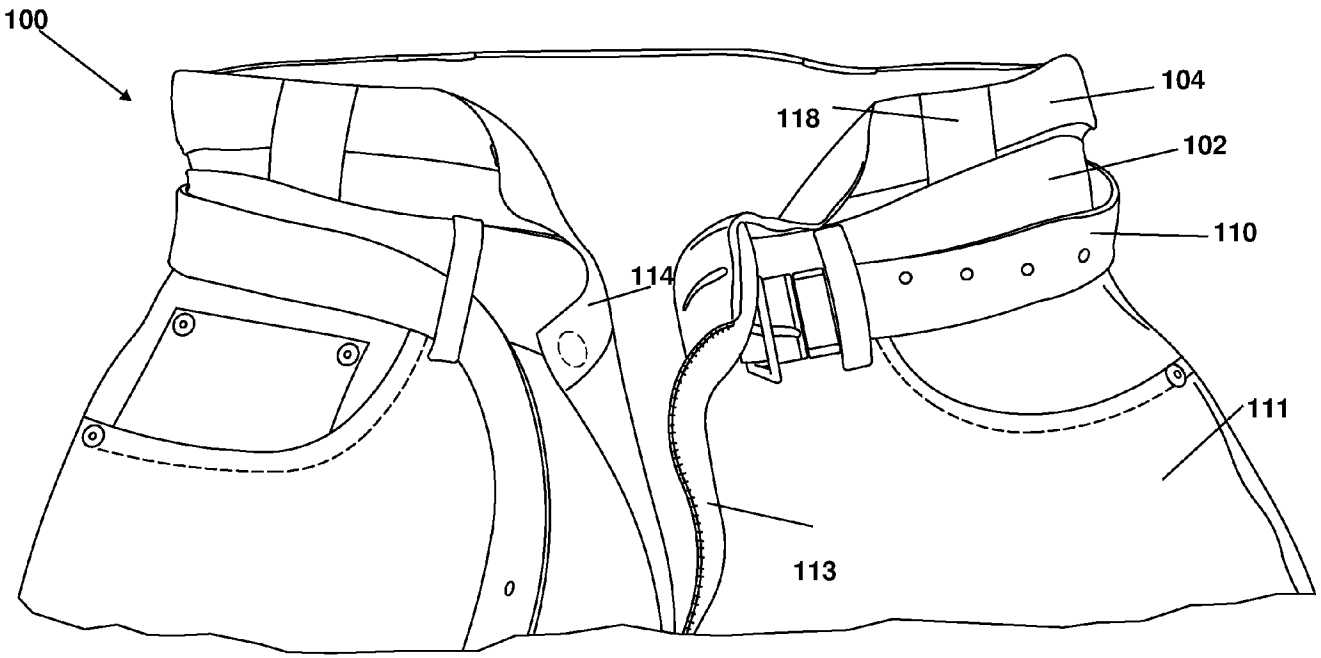
FIG. 7 shows a front view of a garment according to an embodiment of the disclosed technology, where the outer waistband is disposed adjacent the inner waistband and the slits connected to the inner and outer waistbands are aligned to open the garment.

FIG. 7 shows a front view of garment 100 when the outer waistband 102 is disposed adjacent the inner waistband 104, as shown in FIGS. 2 and 5. In the arrangement of FIG. 7, the slit 114 in fabric portion 112 is aligned with the fly 113 of main body portion 111, such that both openings 113 and 114 are opened in order for the user to put on and remove the garment.

It will be appreciated that the garment described hereinabove may be any garment having a waistband, such as a pair of pants, a skirt, or a skort.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods and apparatuses described hereinabove are also contemplated and within the scope of the invention.

The invention claimed is:

1. A garment including:

an outer waistband;

an inner waistband; a main body portion extending from a bottom edge of said outer waistband; and a fabric portion connecting said outer waistband and said inner waistband;

wherein in a first operative mode, said outer waistband is positioned adjacent said inner waistband, and said fabric portion is hidden, and in a second operative mode said outer waistband hangs below said inner waistband, and said fabric portion is visible; and wherein a length of the garment in said second operative mode is greater than a length of said garment in said first operative mode by an amount equal to a length of said fabric portion; and comprising outer fasteners associated with said outer waistband and corresponding inner fasteners associated with said inner waistband, such that, when said outer fasteners and said inner fasteners are connected, said outer waistband is held in said first operative mode.

2. The garment of claim 1, wherein decorative elements are provided only on said main body portion.

3. The garment of claim 1, wherein decorative elements are provided on said main body portion and on said fabric portion.

4. The garment of claim 1, wherein a said fabric portion and said main body portion are made of different fabrics.

5. The garment of claim 4, wherein a fabric forming said fabric portion is thinner than a fabric forming said main body portion.

6. The garment of claim 1, wherein said main body portion includes a main opening, and said fabric portion includes a secondary opening, and wherein in said first operative mode, said main opening and said secondary opening are aligned.

7. The garment of claim 6, wherein, in said second operative mode, only said second opening need be opened for wearing and removal of said garment.

8. The garment of claim 1, wherein said garment comprises pants.

9. The garment of claim 1, wherein said garment comprises a skirt.

10. The garment of claim 1, wherein said garment comprises a skort.

* * * * *